US007198507B2

(12) United States Patent
Tusini

(10) Patent No.: US 7,198,507 B2
(45) Date of Patent: Apr. 3, 2007

(54) HANDGRIP DEVICE FOR COAXIAL CABLE AND COAXIAL CABLE ASSEMBLY INCLUDING HANDGRIP DEVICE

(75) Inventor: Paul M. Tusini, Boxford, MA (US)

(73) Assignee: Times Microwave Systems, Inc., division of Smiths Aerospace, Incorporated, Wallingford, CT (US)

( * ) Notice: Subject to any disclaimer, the term of this patent is extended or adjusted under 35 U.S.C. 154(b) by 0 days.

(21) Appl. No.: 11/053,967

(22) Filed: Feb. 9, 2005

(65) Prior Publication Data

US 2006/0178046 A1 Aug. 10, 2006

(51) Int. Cl.
*H01R 13/00* (2006.01)

(52) U.S. Cl. ..... 439/483; 439/447; 439/578

(58) Field of Classification Search ..... 439/447, 439/445, 578, 483, 480–482, 476.1
See application file for complete search history.

(56) References Cited

U.S. PATENT DOCUMENTS

| | | | | |
|---|---|---|---|---|
| 2,755,451 | A | 7/1956 | Smyers | |
| 3,671,926 | A | 6/1972 | Nepovim | |
| 3,706,958 | A | 12/1972 | Blanchenot | |
| 3,744,011 | A | 7/1973 | Blanchenot | |
| 4,043,630 | A * | 8/1977 | Suverison et al. | 439/606 |
| 4,331,374 | A | 5/1982 | Phillips | |
| 5,030,135 | A * | 7/1991 | Plesinger | 439/447 |
| 5,226,827 | A * | 7/1993 | Corcoles et al. | 439/140 |
| 5,304,073 | A * | 4/1994 | Golobay et al. | 439/282 |
| 5,440,282 | A | 8/1995 | Devendorf et al. | |
| 5,453,029 | A * | 9/1995 | Moldenhauer et al. | 439/606 |
| 5,474,478 | A | 12/1995 | Ballog | |
| 5,586,906 | A * | 12/1996 | Staros et al. | 439/483 |
| 6,733,322 | B2 * | 5/2004 | Boemmel et al. | 439/445 |
| 2004/0014352 | A1 * | 1/2004 | Boemmel et al. | 439/445 |
| 2004/0029433 | A1 * | 2/2004 | Lee et al. | 439/445 |
| 2004/0121646 | A1 * | 6/2004 | Iamartino et al. | 439/445 |

* cited by examiner

*Primary Examiner*—Gary F. Paumen
(74) *Attorney, Agent, or Firm*—McCormick, Paulding & Huber LLP

(57) ABSTRACT

A handgrip device for a coaxial cable includes a first longitudinal section having an inner wall defining a first channel extending therethrough for receiving a connector of a coaxial cable. The first channel has generally a first diameter. A second longitudinal section is generally adjacent to the first longitudinal section for receiving a coaxial cable. The second longitudinal section has an inner wall defining a second channel extending therethrough and communicates with the first channel. The second channel has generally a second diameter which is greater than the first diameter of the first channel such that a space is maintained between the inner wall of the second channel and a coaxial cable when disposed in the second channel, whereby the space protects the coaxial cable adjacent to the connector from damage when fastening or unfastening the connector.

9 Claims, 3 Drawing Sheets

HANDGRIP DEVICE FOR COAXIAL CABLE AND COAXIAL CABLE ASSEMBLY INCLUDING HANDGRIP DEVICE

FIELD OF THE INVENTION

The present invention is generally directed to a handgrip or handle for the connector end of a coaxial cable, and more particularly relates to a handgrip or handle at a connector end of a test coaxial cable which prevents damage to the coaxial cable near the connector while applying torque to the coaxial cable connector while fastening or unfastening the test coaxial cable connector to a mating connector.

BACKGROUND OF THE INVENTION

Coaxial cables or coaxial cable assemblies are often prone to damage from repeated fastening and unfastening of the cable connectors to mating connectors. This is particularly true of a type of cable assembly commonly known as a "test" cable assembly. A test cable assembly comprises a coaxial cable of any kind and a connector of any kind attached to the cable on one or both ends thereof. Test cable assemblies perform a vital, specific and unique function in the electronics industry. Test cable assemblies are used to accurately measure product performance during and after the manufacturing process.

To assure the accuracy of test measurement data, test cables are themselves built and measured very accurately. Their electrical and mechanical performance characteristics are determined and then defined for a specific purpose or use. Users desire test cables to withstand or endure constant and continual connecting and disconnecting to products and/or other interconnect devices without breaking, failing or degrading mechanically or electrically in any way. Users desire test cables to maintain their original performance characteristics even when used in harsh conditions and environments, and even if misused or mishandled. Thus, designing and manufacturing rugged, long life test cables has grown to be an industry unto itself.

Coaxial cables—especially test coaxial cables—typically suffer from two common failure modes: the connector separates or loosens from the cable and/or the coaxial outer conductor is degraded in one of several ways during repeated use when fastening and unfastening the coaxial cable connector to a mating connector. This is caused by a twisting or torquing motion induced into the attachment area between the connector and the coaxial cable by the normal mating together of male and female connectors. Referring to FIG. 1, for example, a coaxial cable assembly 11 having a connector 13, an outer conductor or braid 15, and an outer jacket 17 exhibits typical damage to the outer conductor in a failure-prone area adjacent to the connector as a result of such repeated twisting or torquing action.

To function properly coaxial connectors must be physically and securely connected to the cable outer conductor. When this connection is compromised either partially or fully the cable assembly is generally classified as failed. This invention is applicable to all coaxial cables regardless of cable construction and all coaxial connectors regardless of series (i.e., SMA, Type N, etc), configuration (i.e., straight, right angle, etc) or gender (i.e., male or female).

Coaxial cables can be of virtually any length and design. Such cables generally comprise an inner or center conductor of any construction or metal surrounded by an insulating material of any kind and an outer conductor of any design. The outer conductor is generally made of individual metal wires or solid metal, and is surrounded by an outer insulating cover of any material. The cable includes a male or female coaxial connector of virtually any design or construction, but has as one of its components a solid outer housing of any material attached to one or both ends of a coaxial cable center conductor and outer conductor by any internal connector construction or design.

A failure mode can be more specifically described as one in which the outer conductor cracks, breaks, rips or separates either partially or fully immediately behind or in the general area behind the coaxial connector from rotational torque stress induced during the mating/unmating sequence with connectors of the opposite gender and/or pulling and contracting stress induced during flexing and bending of the coaxial cable during general handling, thus degrading both the mechanical and electrical product specifications.

Typical solutions include applying a strain relief to the coaxial/connector attachment area. The two most common solutions are the application of 1) heat shrink strain relief tubing, and 2) molded plastic "boots". These methods are effective at prohibiting cable or cable/connector interface damage from bending or flexing the cable at the attachment area. However, both of these methods are ineffective at prohibiting damage from radial forces such as the torque or twisting forces that are induced along a longitudinal axis of the cable and connector during the mating together of connectors.

Connectors with cable clamping mechanisms or separate clamping mechanisms have been used to address this problem. While this may be effective for some cables most notably "corrugated" cable or cables with solid metal outer conductors, it is not appropriate, effective or recommended for the vast majority of flexible and all "tin soaked" coaxial cables. Clamps will squeeze and thereby physically deform the cable. The industry considers deformed (that is, no longer perfectly circular) coaxial cables to be failed or at best degraded when used at radio or microwave frequencies.

Based on the foregoing, it is an object of the present invention to provide a coaxial cable assembly and a handgrip device used therewith that overcomes the above-mentioned drawbacks and disadvantages associated with prior coaxial cable assemblies.

SUMMARY OF THE INVENTION

In a first aspect of the present invention, a handgrip device for a coaxial cable comprises a first longitudinal section having an inner wall defining a first channel extending therethrough for receiving a connector of a coaxial cable. The first channel has generally a first diameter. A second longitudinal section is generally adjacent to the first longitudinal section for receiving a coaxial cable. The second longitudinal section has an inner wall defining a second channel extending therethrough and communicates with the first channel. The second channel has generally a second diameter which is greater than the first diameter of the first channel such that a space is maintained between the inner wall of the second channel and a coaxial cable when disposed in the second channel, whereby the space protects the coaxial cable adjacent to the connector from damage when fastening or unfastening the connector.

In a second aspect of the present invention, a coaxial cable assembly comprises a coaxial cable including at least one connector coupled to a longitudinal end thereof. The coaxial cable assembly further comprises a handgrip device including a first longitudinal section having an inner wall defining a first channel extending therethrough for receiving the connector of the coaxial cable. The first channel has generally a first diameter. A second longitudinal section is generally adjacent to the first longitudinal section for receiving the coaxial cable. The second longitudinal section has an inner wall defining a second channel extending therethrough and communicates with the first channel. The at least one connector of the coaxial cable has an outer wall to oppose the inner wall of the first longitudinal section. The coaxial cable has an outer wall to be spaced inwardly from the inner wall of the second longitudinal section. The second channel has generally a second diameter which is greater than the first diameter of the first channel such that a space is maintained between the inner wall of the second channel and the coaxial cable when disposed in the second channel, whereby the space protects the coaxial cable adjacent to the connector from damage when fastening or unfastening the connector.

DETAILED DESCRIPTION OF THE PREFERRED EMBODIMENTS

Figure 1:
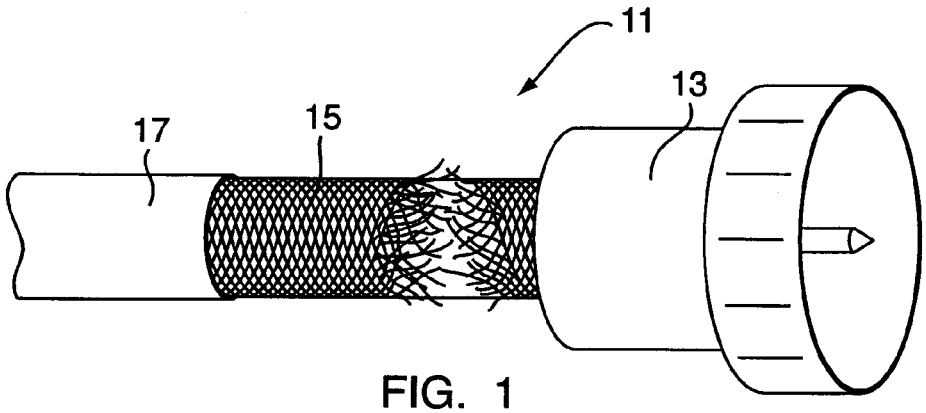
FIG. 1 Prior Art
FIG. 1 is a perspective view of a prior coaxial cable assembly exhibiting damage to a failure-prone portion of the outer conductor.

With reference to FIGS. 2–7, a coaxial cable assembly embodying the present invention is indicated generally by the reference number 10. The coaxial cable assembly comprises a designed, molded or machined handgrip device 12, and a coaxial cable 14 including at least one connector 16 coupled to a longitudinal end 18 of the coaxial cable. The coaxial cable assembly 10 preferably further comprises a strain relief grommet 20 at a rear exit point of the handgrip device 12 for strain relief during bending of the coaxial cable 14.

The handgrip device 12 includes a first longitudinal section 22 having an inner wall 24 defining a first channel 25 extending therethrough from a first longitudinal position 26 to a second longitudinal position 28 for receiving the connector 16 of the coaxial cable 14. The first channel 25 has generally a first diameter D1 such that the inner wall 24 is adjacent to or abuts an outer wall 30 of the connector 16.

The handgrip device 12 further includes a second longitudinal section 32 disposed generally adjacent to the first longitudinal section 22, and having an inner wall 34 defining a second channel 36 extending therethrough from the second longitudinal position 28 to a third longitudinal position 38 for receiving a body of the coaxial cable 14. The second channel 36 communicates with the first channel 25. The coaxial cable 14 has an outer wall 42 to be spaced inwardly from the inner wall 34 of the second longitudinal section 32. The second channel 36 has generally a second diameter D2 which is greater than the first diameter D1 of the first channel 25 such that a space is defined between the inner wall 34 of the second longitudinal section 32 and the outer wall 42 of the coaxial cable 14 when disposed in the second channel, whereby the space protects a longitudinal portion of the coaxial cable adjacent to the connector 16 from damage when fastening or unfastening the connector to an external mating connector. In other words, the handgrip device 12 spans and does not touch the coaxial cable 14 at least over a longitudinal portion of the coaxial cable adjacent to the connector 16.

The handgrip device 12 provides structure for easily and securely gripping the connector 16 in a user's hand to resist and thus eliminate or significantly reduce the torque stress induced into the outer conductor of the coaxial cable 14 from threading or screwing on and tightening a coupling nut of the connector to the proper torque specifications—typically accomplished using a wrench. The cable-spanning feature removes the possibility of inducing stress into the outer conductor in the same, failure-prone area as a result of bending or flexing the coaxial cable 14. The strain relief grommet 20 is secured at a rear exit point of the handgrip device 12, preferably several inches away from the connector 16. The handgrip device 12 holds the coaxial cable 14 straight in the delicate, failure prone area of a length of the coaxial cable protruding from the connector 16. The strain relief grommet 20 then dilutes and spreads the stresses induced from coaxial cable flexing along a greater area, but importantly away from the cable/connector attachment area where the center conductor and outer conductor of the coaxial cable are securely held.

Figure 2:
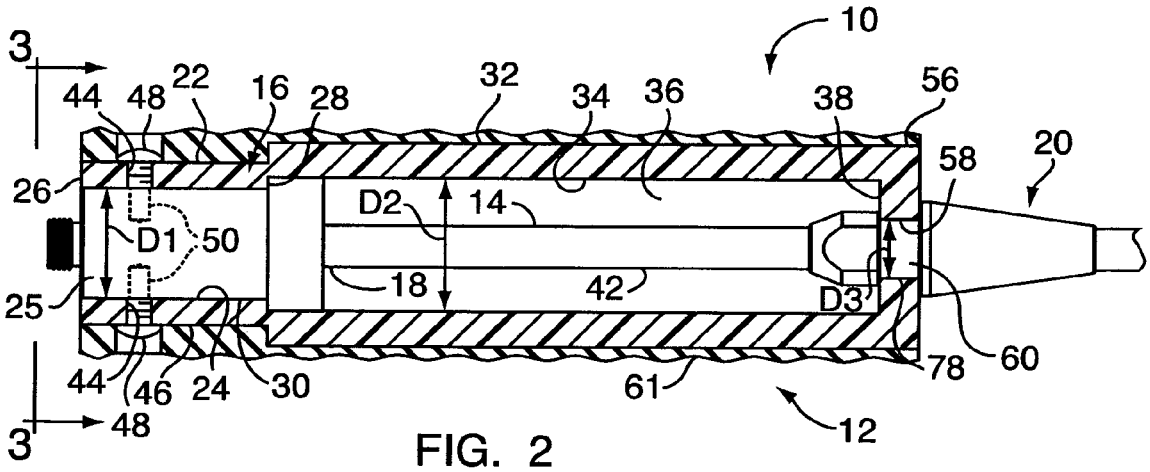
FIG. 2 is an elevational view of a coaxial cable assembly in accordance with the present invention.
Figure 3:
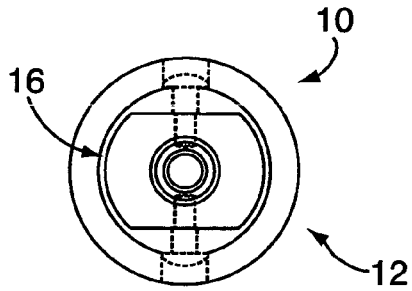
FIG. 3 is an end view of the coaxial cable assembly taken along the lines 3—3 in FIG. 1.
Figure 4:
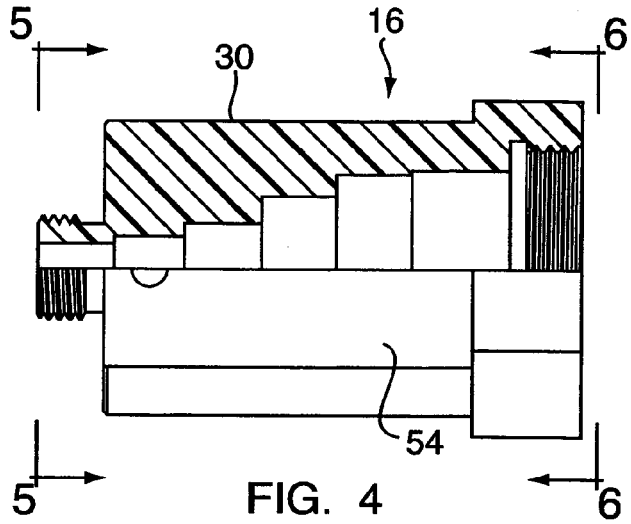
FIG. 4 is a partial, cross-sectional elevational view of a connector of a coaxial cable assembly in accordance with the present invention.
Figure 5:
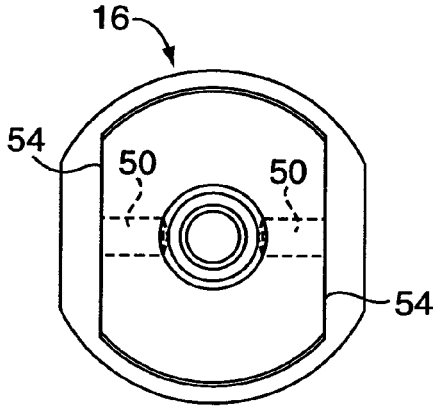
FIG. 5 is an end view of the connector taken along the lines 5—5 of FIG. 4.
Figure 6:
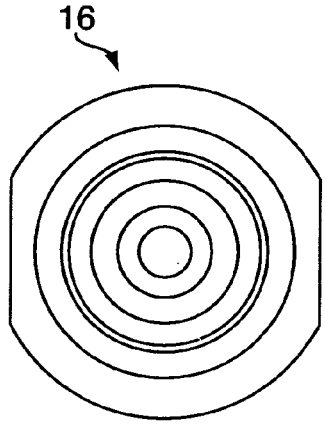
FIG. 6 is an end view of the connector taken along the lines 6—6 of FIG. 4.

As shown in FIG. 2, the first longitudinal section 22 of the handgrip device 12 defines two holes 44 disposed generally at opposite sides of the first longitudinal section relative to each other. Each of the two holes 44 extends from an outer surface 46 to the inner wall 24 for receiving a fastener 48 therethrough such as, but not limited to, a set screw. The outer wall 30 of the connector 16 defines two recesses 50 at opposite sides of the connector relative to each other. Each recess 50 coincides with an associated hole 44 for enabling the fastener 48 to be received through the recess and the hole to thereby couple the handgrip device 12 to the connector 16 and thereby prevent the connector from pulling out of the handgrip device.

Figure 7:
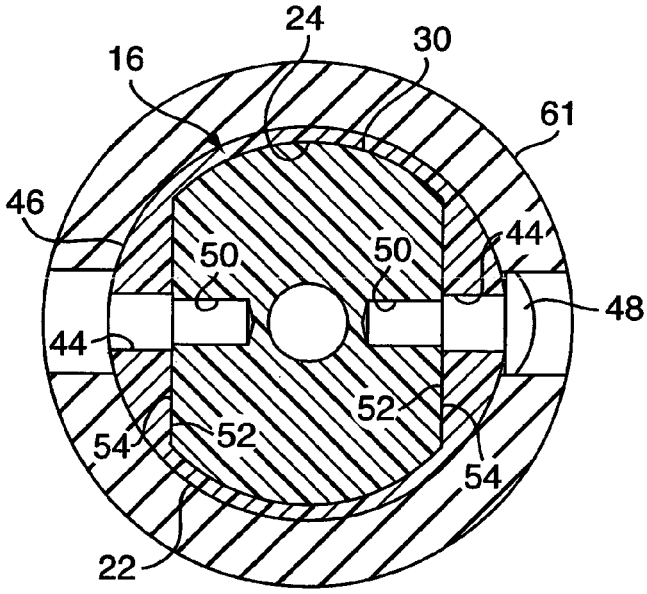
FIG. 7 is a cross-sectional end view of a set screw engaging a connector of a coaxial cable assembly in accordance with the present invention.
Figure 8:
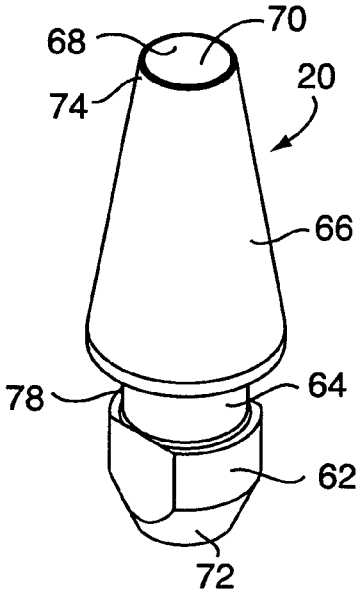
FIG. 8 is a perspective view of a strain relief grommet for use with a coaxial cable assembly in accordance with the present invention.
Figure 9:
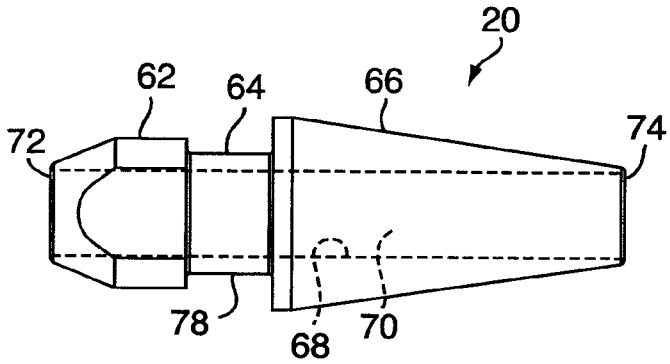
FIG. 9 is an elevational view of the strain relief grommet of FIG. 8.
Figure 12:
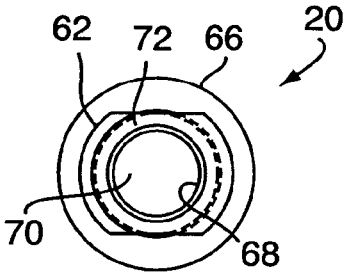
FIG. 12 is an end view of the strain relief grommet taken along the lines 12—12 in FIG. 9.
Figure 10:
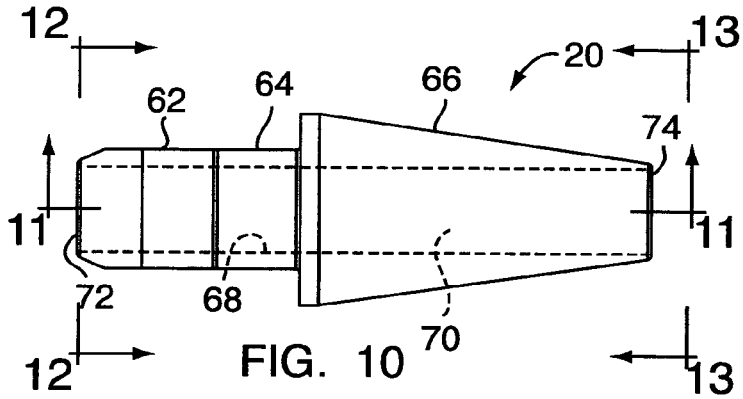
FIG. 10 is an elevational view of the strain relief grommet taken along the lines 10—10 in FIG. 9.
Figure 11:
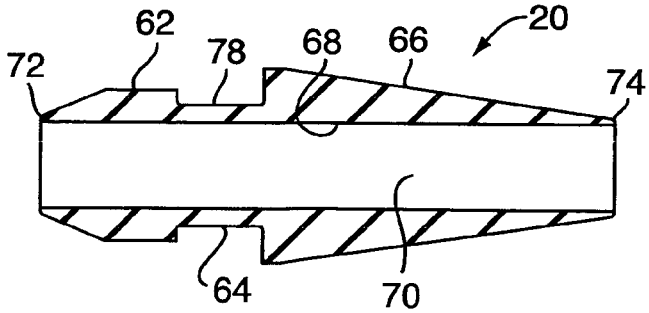
FIG. 11 is a cross-sectional view of the strain relief grommet taken along the lines 11—11 in FIG. 10.
Figure 13:
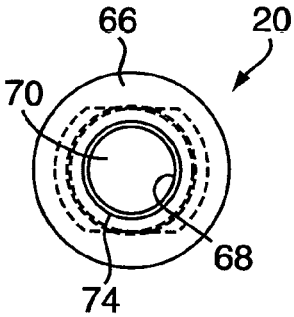
FIG. 13 is an end view of the strain relief grommet taken along the lines 13—13 in FIG. 9.

As shown in FIG. 7, the handgrip device 12 includes two radial portions 52 disposed on generally opposite sides of the inner wall 24 of the first longitudinal section 22 which are asymmetrically shaped or "keyed" relative to other radial portions to engage similarly shaped radial portions 54 of the connector 16 of the coaxial cable 14 to prevent the coaxial cable from rotating relative to the handgrip device 12. Preferably, the two radial portions 52 of the handgrip device 12 are each generally flat to engage a similarly shaped flat radial portion 54 of the connector 16. However, the radial portions 52, 54 of the first longitudinal section 22 and the connector 16 can have other practical shapes without departing from the scope of the present invention.

As best shown in FIG. 7, one of the holes 44 (illustrated on right side only) extends from the outer surface 46 to the inner wall 24, and one of the recesses 50 coincides with the associated hole 44 for accommodating a set screw 48 in the hole and recess to secure the handgrip device 12 to the connector 16.

As shown in FIG. 2, the handgrip device 12 preferably further comprises a third longitudinal section 56 disposed adjacent to an opposite longitudinal end of the second longitudinal section 32 relative to the first longitudinal section 22 for engaging the strain relief grommet 20. The third longitudinal section 56 has an inner wall 58 defining a third channel 60 extending therethrough and communicating with the second channel 36. The third channel 60 has generally a third diameter D3 which is less than the second diameter D2 of the second channel 36. Preferably, the handgrip device 12 includes a jacket 61 extending peripherally about the longitudinal sections 22, 32, 56. The jacket 61 can be fabricated from rubber, synthetic rubber or other resilient material that is easily gripped and able to be firmly held in a user's hand.

As shown in FIGS. 8–13, the strain relief grommet 20, preferably fabricated from a rubber, synthetic rubber or other resilient material, includes a first longitudinal section 62, a second longitudinal section 64 and a third longitudinal section 66. The strain relief grommet 20 has an interior wall 68 defining a channel 70 extending from a first longitudinal end 72 to a second longitudinal end 74 for accommodating a coaxial cable. The first longitudinal section 62 is adapted to be pushed through the third longitudinal section 56 and into the second channel 36 of the handgrip device 12. The second longitudinal section 64 of the strain relief grommet 20 has an outer wall having a reduced diameter or width relative to the first and third longitudinal sections 62, 66 so as to define a groove 78 extending circumaxially about a longitudinal axis for engaging the third longitudinal section 56 of the handgrip device 12. The groove 78 enables the strain relief grommet 20 to be secured to the handgrip device 12.

In operation, the longitudinal sections 22, 32, 56 of the handgrip device 12 are fabricated from a generally or slightly flexible material that, when properly fitted or applied to any flexible coaxial cable assembly spans and protects but does not touch the portion of the coaxial cable immediately behind or in the area behind the connector—generally regarded as the most delicate or failure prone area of a flexible cable assembly. The present invention significantly reduces the likelihood of early coaxial cable assembly failure and significantly lengthens or improves the service life of the coaxial cable assembly. This is particularly true of coaxial cable assembly configurations designed for constant handling, flexing, mating and unmating and/or applications that also require the transmission of RF signals with specific and predetermined electrical properties over extended periods of time under the same conditions such as RF test cables.

While the present invention has been described in a preferred embodiment, it will be understood that numerous modifications and substitutions can be made without departing from the scope and spirit of the invention. Accordingly, the present invention has been described in a preferred embodiment by way of illustration, rather than limitation.

What is claimed is:

1. A coaxial cable assembly, comprising:

a coaxial cable including at least one connector coupled to a longitudinal end thereof; and a handgrip device including:

a first longitudinal section having an inner wall defining a first channel extending therethrough for receiving the connector of the coaxial cable, the first channel having generally a first diameter;

a second longitudinal section generally adjacent to the first longitudinal section for receiving the coaxial cable, the second longitudinal section having an inner wall defining a second channel extending therethrough and communicating with the first channel, the at least one connector of the coaxial cable having an outer wall to oppose the inner wall of the first longitudinal section, and the coaxial cable having an outer wall to be spaced inwardly from the inner wall of the second longitudinal section, the second channel having generally a second diameter which is greater than the first diameter of the first channel such that a space is maintained between the inner wall of the second channel and the coaxial cable when disposed in the second channel, whereby the space protects the coaxial cable adjacent to the connector from damage when fastening or unfastening the connector; and a third longitudinal section adjacent to an opposite longitudinal end of the second longitudinal section relative to the first longitudinal section for engaging a strain relief grommet for a coaxial cable, the third longitudinal section having an inner wall defining a third channel extending therethrough and communicating with the second channel, the third channel having generally a third diameter which is less than the second diameter of the second channel; and a strain relief grommet for being received on the coaxial cable, the strain relief grommet having an outer wall defining a groove extending circumaxially about a longitudinal axis for engaging the third longitudinal section of the handgrip device.

2. A coaxial cable assembly as defined in claim 1, wherein the strain relief grommet is made of a resilient material.

3. A coaxial cable assembly as defined in claim 1, wherein the first longitudinal section defines at least one hole extending from an outer surface to the inner wall for receiving a fastener therethrough, and wherein an outer wall of the at least one connector defines a recess to coincide with the at least one hole for engaging an end of a fastener to couple the handgrip device to the at least one connector of the coaxial cable.

4. A coaxial cable assembly as defined in claim 1, wherein the first longitudinal section defines two holes disposed generally at opposite sides of the first longitudinal section relative to each other, each of the two holes extending from an outer surface to the inner wall for receiving a fastener therethrough, and wherein an outer wall of the at least one connector defines two recesses at opposite sides of the at least one connector relative to each other, each recess to coincide with a respective one of the two holes for coupling the handgrip device to the at least one connector of the coaxial cable.

5. A coaxial cable assembly as defined in claim 3, wherein the fastener is a set screw.

6. A coaxial cable assembly as defined in claim 1, wherein at least one radial portion of the inner wall of the first longitudinal section and at least one radial portion of the at least one connector of the coaxial cable are shaped for engaging one another to prevent the coaxial cable from rotating relative to the handgrip device.

7. A coaxial cable assembly as defined in claim 1, wherein at least one radial portion of the inner wall of the first longitudinal section is generally flat and at least one radial portion of the at least one connector of the coaxial cable is generally flat to enable the radial portions to engage one another and prevent the coaxial cable from rotating relative to the handgrip device.

8. A coaxial cable assembly as defined in claim 1, wherein two radial portions disposed on generally opposite sides of the inner wall of the first longitudinal section are each shaped to engage a similarly shaped radial portion of the at least one connector of the coaxial cable to prevent the coaxial cable from rotating relative to the handgrip device.

9. A coaxial cable assembly as defined in claim 1, wherein two radial portions disposed on generally opposite sides of the inner wall of the first longitudinal section are each generally flat to engage a similarly shaped radial portion of the at least one connector of the coaxial cable to prevent the coaxial cable front rotating relative to the handgrip device.

* * * * *